US006791512B1

(12) United States Patent
Shimada

(10) Patent No.: US 6,791,512 B1
(45) Date of Patent: Sep. 14, 2004

(54) IMAGE DISPLAY DEVICE

(75) Inventor: Naoto Shimada, Hachioji (JP)

(73) Assignee: Olympus Corporation (JP)

( * ) Notice: Subject to any disclaimer, the term of this patent is extended or adjusted under 35 U.S.C. 154(b) by 331 days.

(21) Appl. No.: 09/620,854

(22) Filed: Jul. 21, 2000

(30) Foreign Application Priority Data

Aug. 3, 1999 (JP) ..... 11-220436

(51) Int. Cl.[7] ..... G09G 3/00
(52) U.S. Cl. ..... 345/32; 345/626; 349/76
(58) Field of Search ..... 345/81, 32, 87, 345/88, 90, 626; 349/75, 96, 193–194; 348/767

(56) References Cited

U.S. PATENT DOCUMENTS

| | | | | | |
|---|---|---|---|---|---|
| 4,517,579 | A | * | 5/1985 | Kitamura | 347/133 |
| 4,727,418 | A | * | 2/1988 | Kato et al. | 348/231 |
| 4,853,592 | A | * | 8/1989 | Strathman | 313/495 |
| 5,602,679 | A | * | 2/1997 | Dolgoff et al. | 359/640 |
| 6,542,609 | B1 | * | 4/2003 | Ryan et al. | 380/210 |

FOREIGN PATENT DOCUMENTS

| | | |
|---|---|---|
| JP | 463332 | 2/1992 |
| JP | 736054 | 2/1995 |

* cited by examiner

*Primary Examiner*—Bipin Shalwala
*Assistant Examiner*—Ricardo Osorio
(74) *Attorney, Agent, or Firm*—Ostrolenk, Faber, Gerb & Soffen, LLP

(57) ABSTRACT

This invention is an image display device comprising an LCD in which plural pixels are two-dimensionally arranged; a digital image processing circuit for controlling in the LCD for each pixel to display an image on the basis of image signals; a wobbling optical element, which is composed of a liquid crystal cell or a birefringence, for sequentially refracting optical paths of beams emitted from the display element to perform pixel-staggering; and a mask circuit for masking end areas in the horizontal direction, where the wobbling optical element performs pixel-staggering by a length longer than a pitch of the pixels so that pixel density is thin, so as to be displayed in black; and a control signal generator for judging whether any subject pixel is a pixel to be masked on the basis of a start signal, a vertical synchronization signal, a horizontal synchronization signal, a clock and the like. This device makes it possible that a more exact image is displayed by a limited number of pixels to be more easily watched.

4 Claims, 12 Drawing Sheets

IMAGE DISPLAY DEVICE

The application claims benefit of Japanese Application No. Hei 11-220436 filed in Japan on Aug. 3, 1999, the contents of which are incorporated by reference.

BACKGROUND OF THE INVENTION

1. Field of the Invention

The present invention relates to an image display device, and in particular to an image display device for increasing the apparent number of pixels by pixel-staggering.

2. Related Art Statement

Hitherto, image display devices using a CRT have been widely used. In recent years, however, the market share of image display devices using a liquid crystal display element or the like has been expanding.

In such image display devices, the exactitude of a displayed image is basically decided by the number of pixels constituting the liquid crystal display element. If the pixel number is increased to obtain a highly exact image, costs ill the liquid crystal display element rise or a higher-speed signal processing circuit becomes necessary.

Thus, there are developed techniques for displaying a more exact image, using a liquid crystal display element whose pixel number is limited.

One example of such a technique is increasing the apparent number of pixels by performing pixel-staggering operation called wobbling, in which the optical axis of light from a liquid crystal display element is vibrated toward a given direction.

Examples of this wobbling technique include two-point pixel-staggering technique wherein apparent pixel positions are shifted in an even number field and an odd number field, and four-point pixel-staggering technique wherein each of the fields is further divided into two sub-fields and apparent pixel positions are shifted in each of these sub-fields.

For example, Japanese Unexamined Patent Publication No. Hei 4-63332 discloses a method for improving solution of a liquid crystal display panel, using two combinations of a liquid crystal panel for controlling the direction of polarized light and a crystal plate, and 4 frame memories. The method disclosed therein involves shifting an image by a ½ pixel pitch in the horizontal direction by a combination of the liquid crystal panel for controlling the direction of polarized light and the crystal plate, and shifting the image by a ½ pixel pitch in the vertical direction by means of the other combination of the liquid crystal panel for controlling the direction of polarized light and the crystal plate. In this manner, four-point pixel-staggering is performed to improve resolution. That is, 4 fields constitute one frame, and an image is divided into 4 images. The respective division images are memorized in the frame memories. In the first field, the division image is caused to go straight in the two liquid crystal panels and displayed. In the second field, the division image is shifted in the horizontal direction by a ½ pixel pitch and displayed. In the third field, the division image is shifted to the vertical direction by a ½ pixel pitch and displayed. In the fourth field, the division image is shifted in the horizontal and vertical directions by ½ pixel pitches, respectively, and displayed. By synthesizing these images, a highly exact image based on 4-point pixel-staggering is displayed.

Japanese Unexamined Patent Publication No. Hei 7-36054 discloses an optical device having two one-dimensional two-point pixel-staggering elements composed of a liquid crystal phase modulating element and a birefringence medium. The one element is laminated on the other element in such a manner that the former is positioned at a rotation angle of 90° from the latter around the axis of incident light. Inside one frame or one field, pixel-staggering is performed 4 times in vertical and horizontal directions. In this way, this device uses two-dimensional four-point pixel-staggering to make its resolution high.

Concerning an image display device using the four-point pixel-staggering, the Applicant developed a technique wherein pixels to be staggered are not positioned at respective apexes of a rectangle but are positioned at respective apexes of a parallelogram to improve resolution in both horizontal and vertical directions. This technique is described in Japanese Patent Application No. Hei 10-336482, which has not yet been opened to the public.

The technique as described in Japanese Patent Application No. Hei 10-336482 has the advantage that the apparent pixel density over the whole of an image is made high except peripheral portions of a screen to improve exactitude of the image. However, for example, at right and left ends of peripheral portions of the screen, areas whose apparent pixel density is thin are inconveniently generated such that resolution cannot be improved. Only the right and left ends of the peripheral portions display partial images which are poorer in exactitude than other areas, for example, the central area of the screen. Regardless of the fact that areas having partial images whose exactitude is low are only a little in the whole and further these areas are at the right and left areas, such an image causes a drop in ease of watching the screen for users.

OBJECT(S) AND SUMMARY OF THE INVENTION

An object of the present invention is to provide an image display device that makes it possible to watch easily a more exact image through a limited number of pixels.

A first aspect of the present invention is an image display device comprising a display element in which plural pixels are arranged, pixel-staggering means for sequentially changing optical paths of beams emitted from the respective pixels of the display element, and mask means for prohibiting image-display at peripheral areas where apparent density of the pixels is thin when pixel-staggering is performed by the pixel-staggering means.

A second aspect of the present invention is an image display device comprising a display element in which plural pixels are two-dimensionally arranged, image processing means for controlling in the display element for each pixel to display an image on the basis of image signals, optical path changing means for sequentially refracting optical paths of beams emitted from the display element to perform pixel-staggering, and mask means for displaying end areas in at least one direction of the horizontal direction and end areas in the vertical direction in black when pixel-staggering is performed by the optical path changing means.

These object(s) and advantages of the present invention will become further apparent from the following detailed explanation.

DETAILED DESCRIPTION OF THE PREFERRED EMBODIMENT(S)

Referring to the attached drawings, embodiments of the present invention will be described hereinafter.

Figure 1:
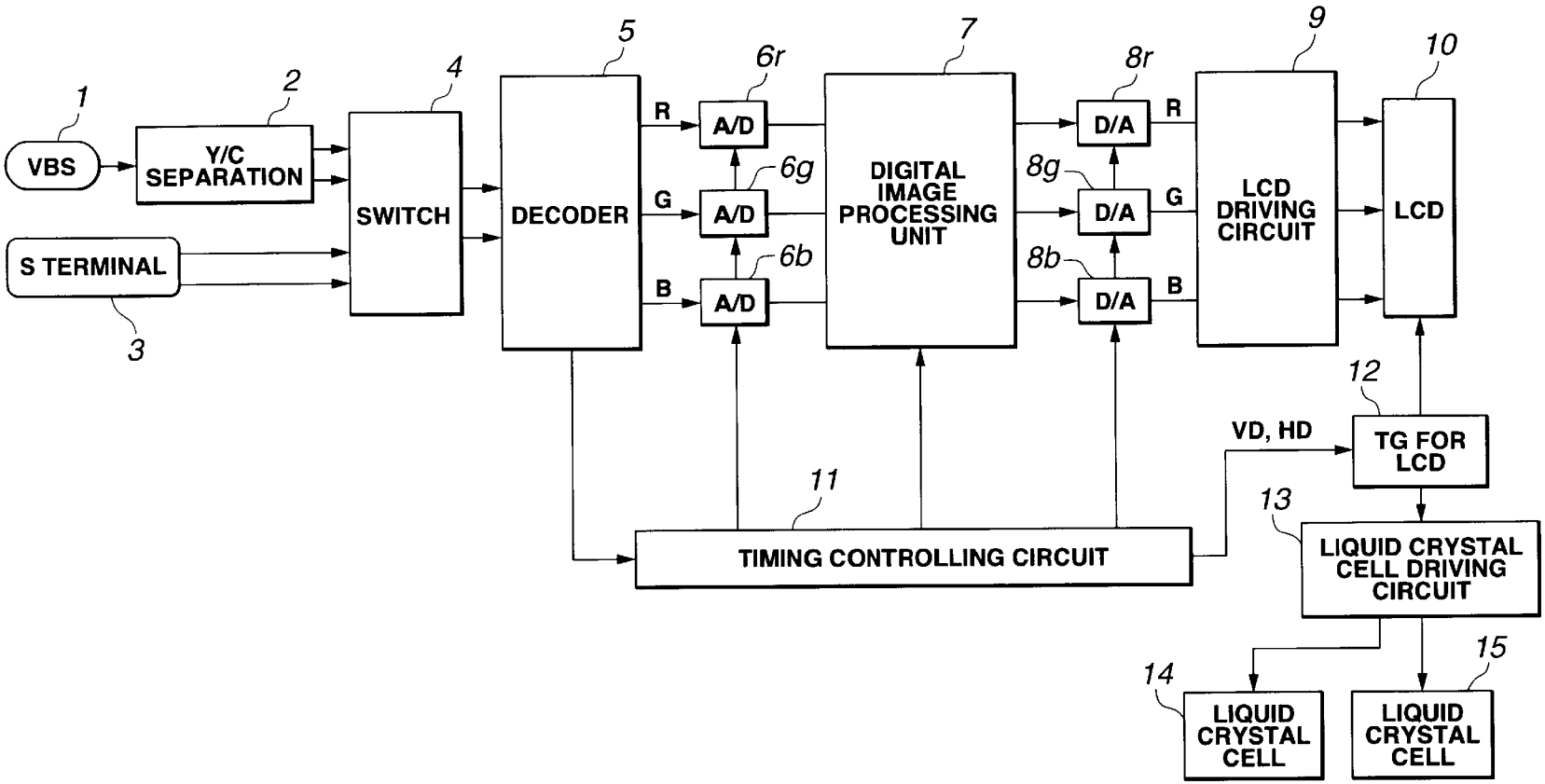
FIG. 1 is a block diagram showing electrical components related mainly to the flow of image signals in an image display device of an embodiment in the present invention.
Figure 2:
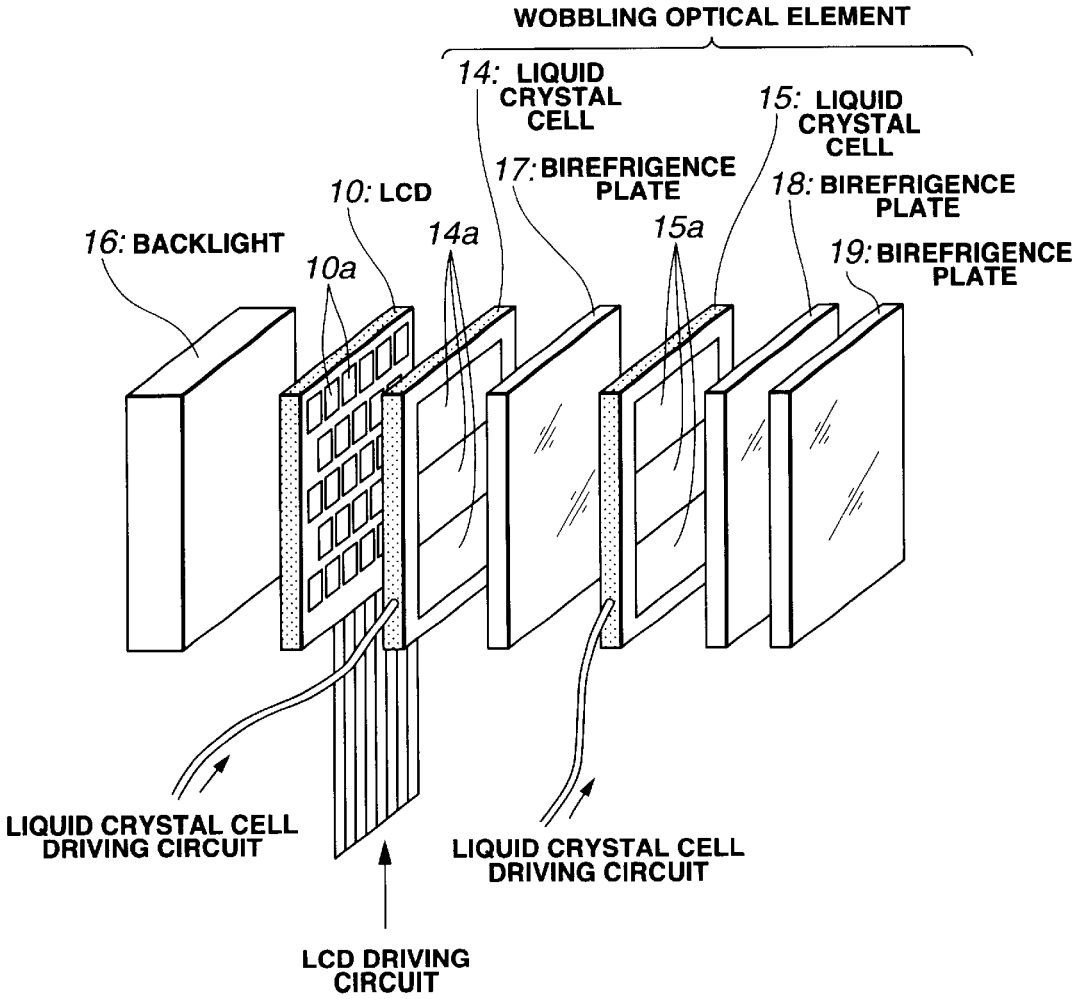
FIG. 2 is a perspective view showing optical components of the image display device of the above-mentioned embodiment.
Figure 3:
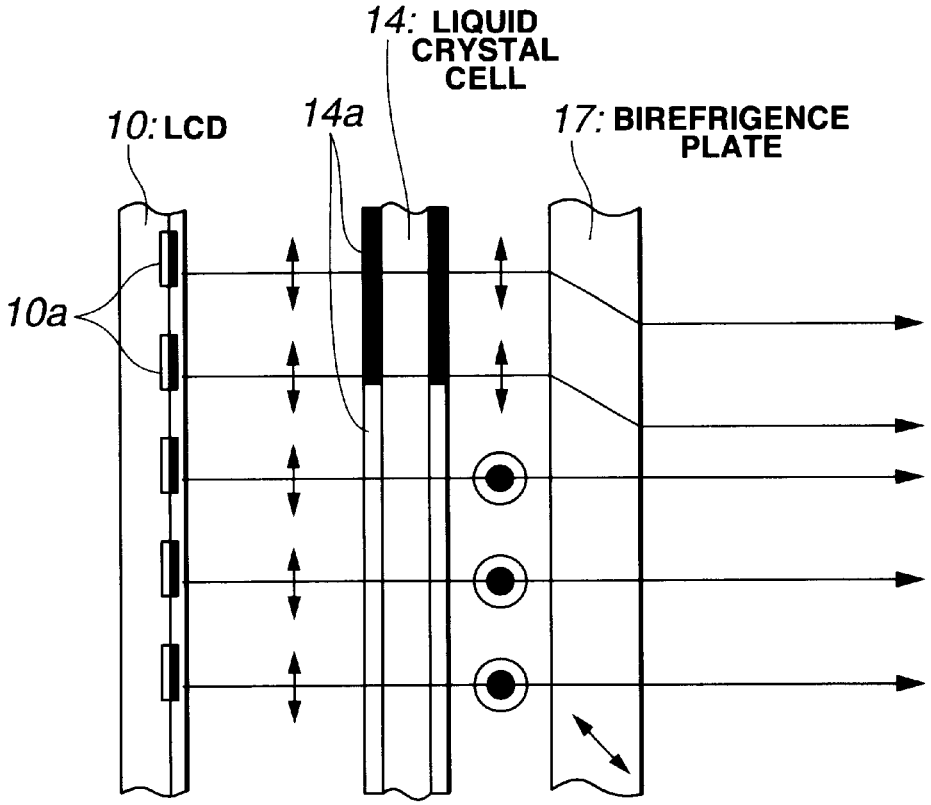
FIG. 3 is a view showing a situation of wobbling by a liquid crystal cell and a birefringence plate in the above-mentioned embodiment, when being seen from its side thereof.
Figure 4A:
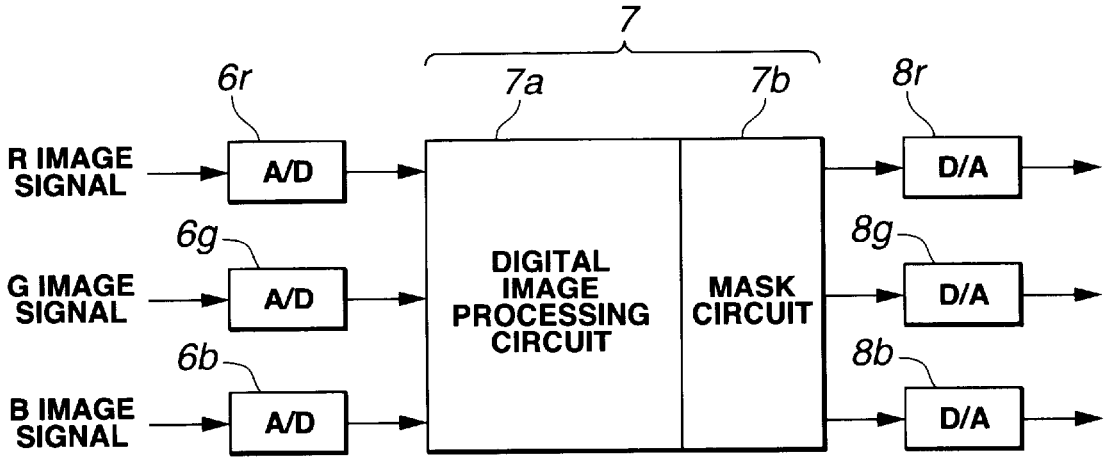
FIG. 4A is a block diagram showing components of a digital image processing unit of the above-mentioned embodiment.
Figure 4B:
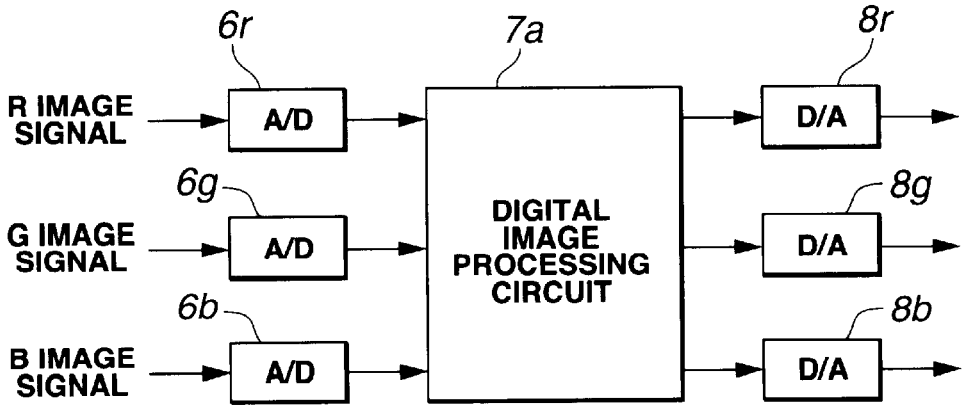
FIG.4B RELATED ART
FIG. 4B is a block diagram showing components of a digital image processing unit of related art.
Figure 5:
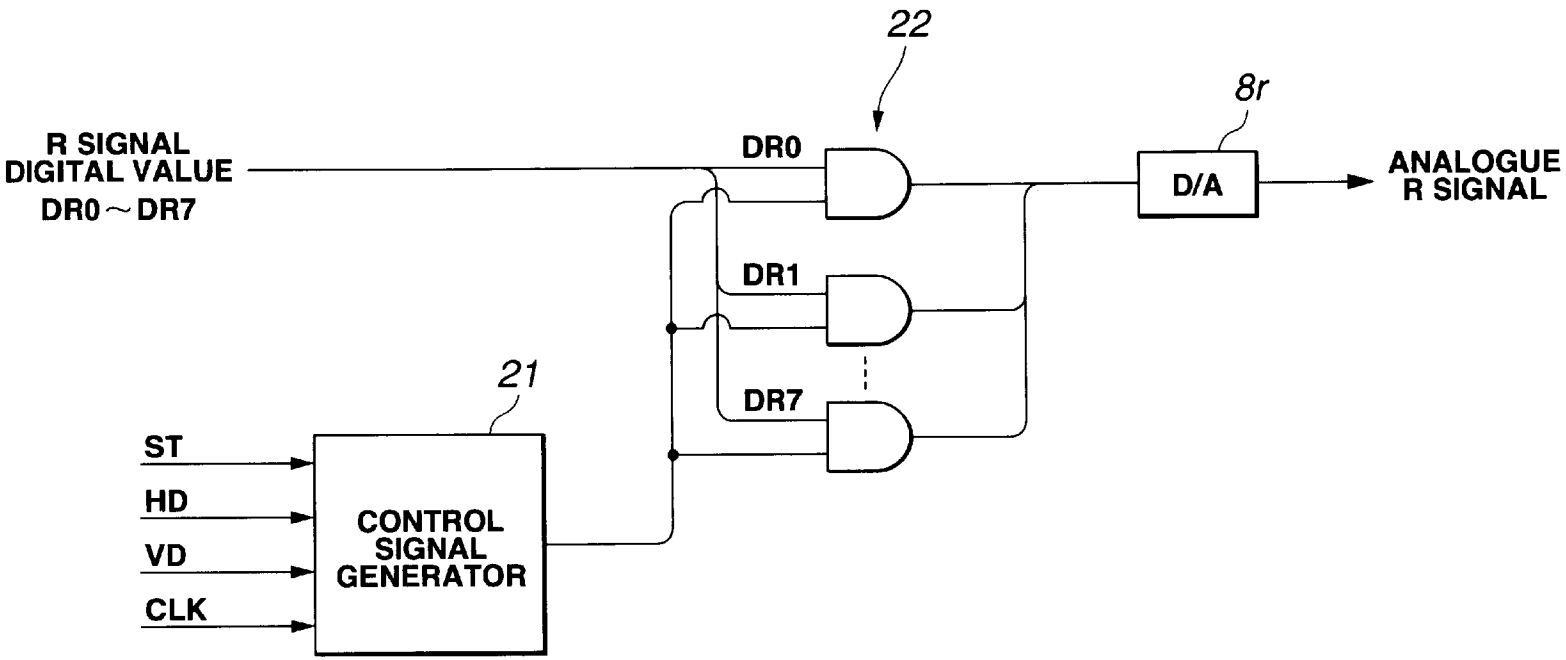
FIG. 5 is a block diagram showing components of a mask circuit related to an R signal in the above-mentioned embodiment.
Figure 8:
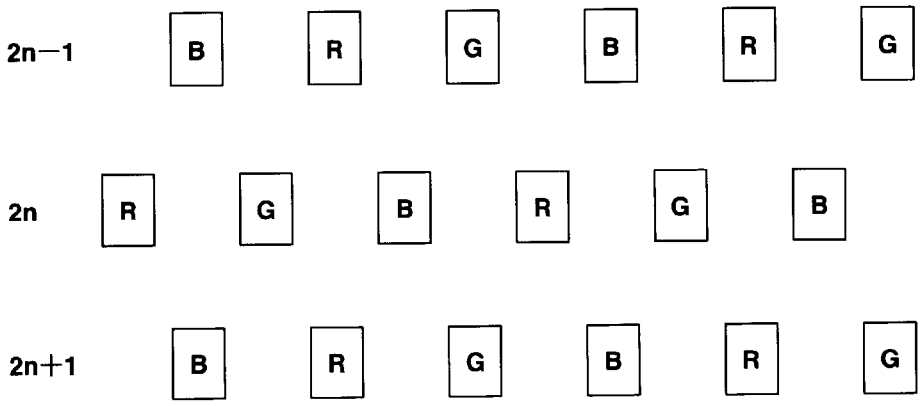
FIG. 8 is a diagram showing a pixel arrangement of a delta-arranged LCD in the above-mentioned embodiment.
Figure 9:
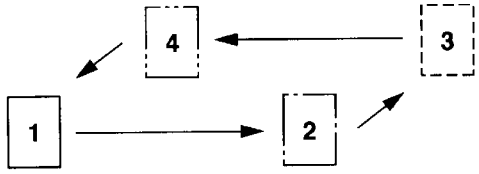
FIG. 9 is a diagram showing how apparent positions of pixels on the LCD are shifted by four-point pixel-staggering in the above-mentioned embodiment.
Figure 10:
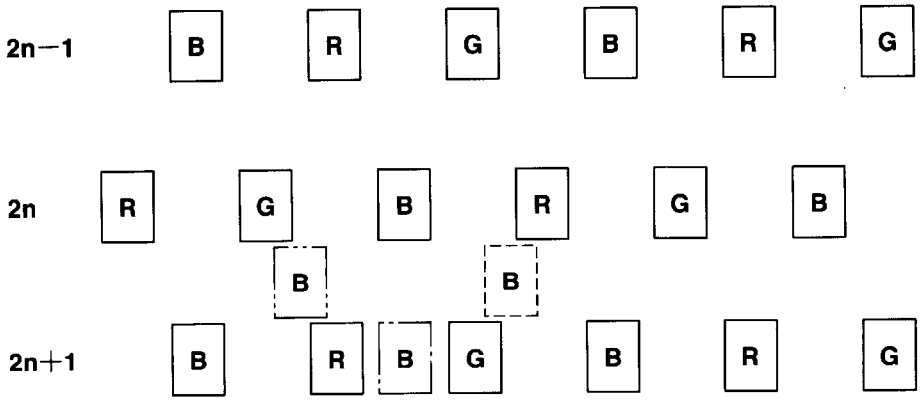
FIG. 10 is a diagram showing how a certain B pixel among plural pixels delta-arranged on the LCD is shifted by four-point pixel-staggering in the above-mentioned embodiment.
Figure 11:
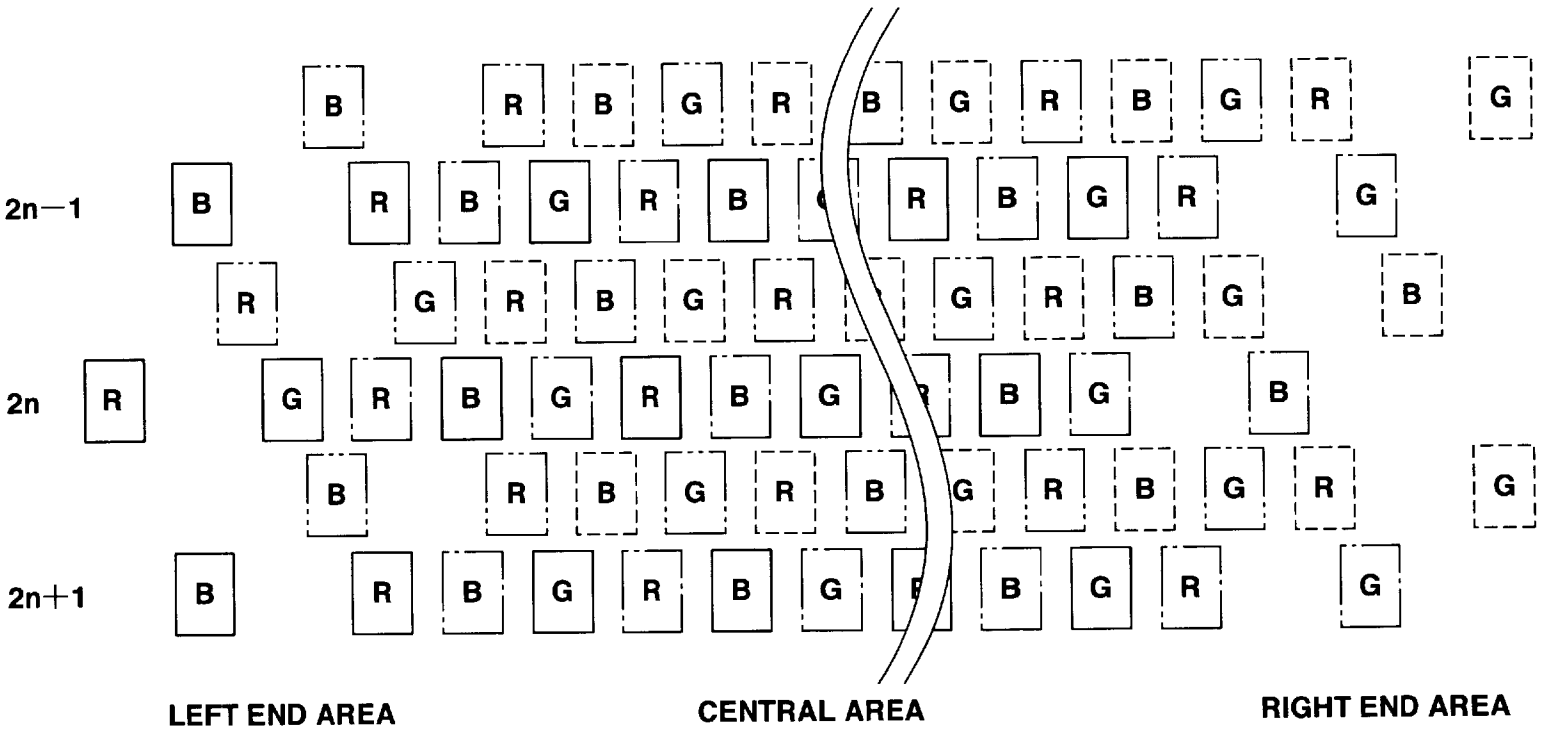
FIG. 11 is a diagram showing how plural pixels delta-arranged on the LCD are shifted by four-point pixel-staggering in the above-mentioned embodiment.
Figure 12:
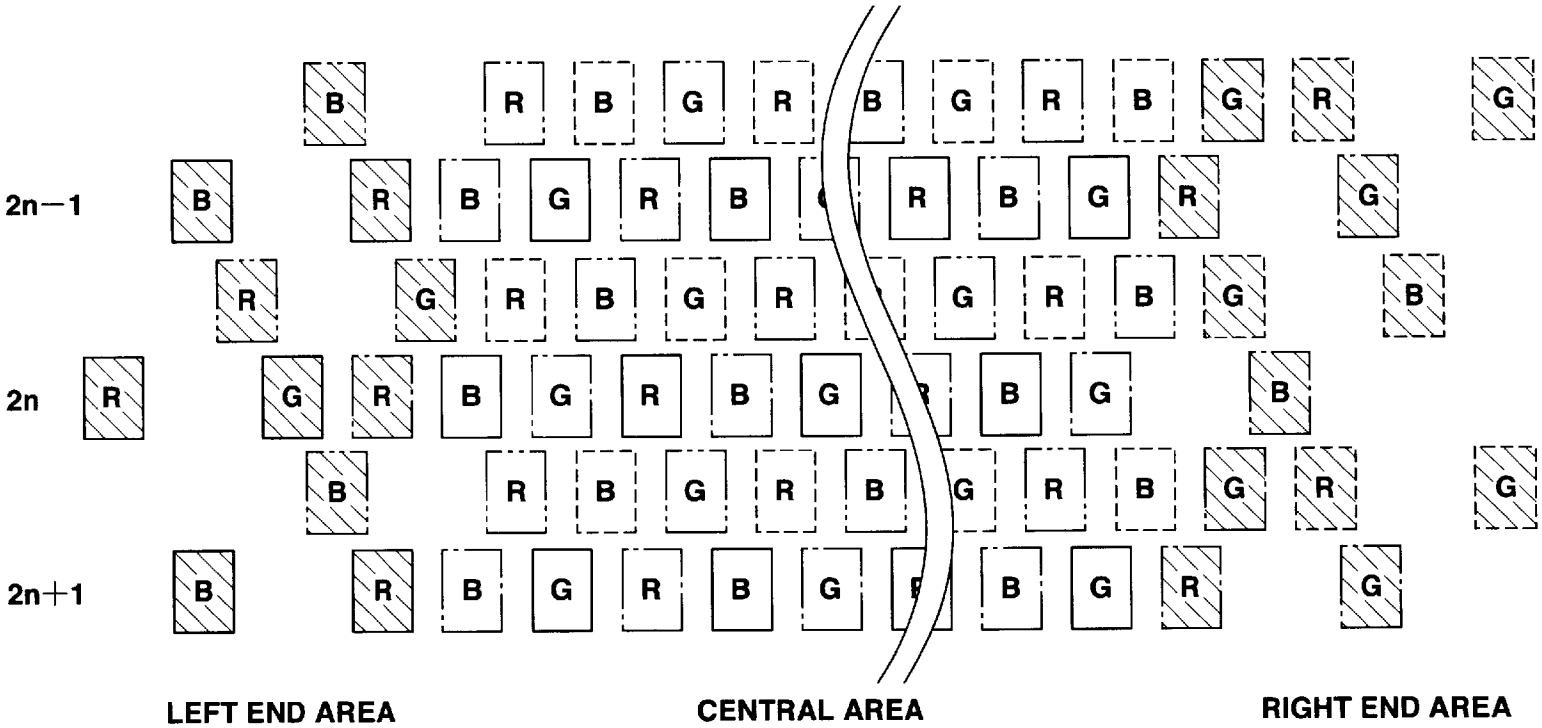
FIG. 12 is a diagram showing pixels to be masked in areas where pixel density is thin in FIG. 11.
Figure 13:
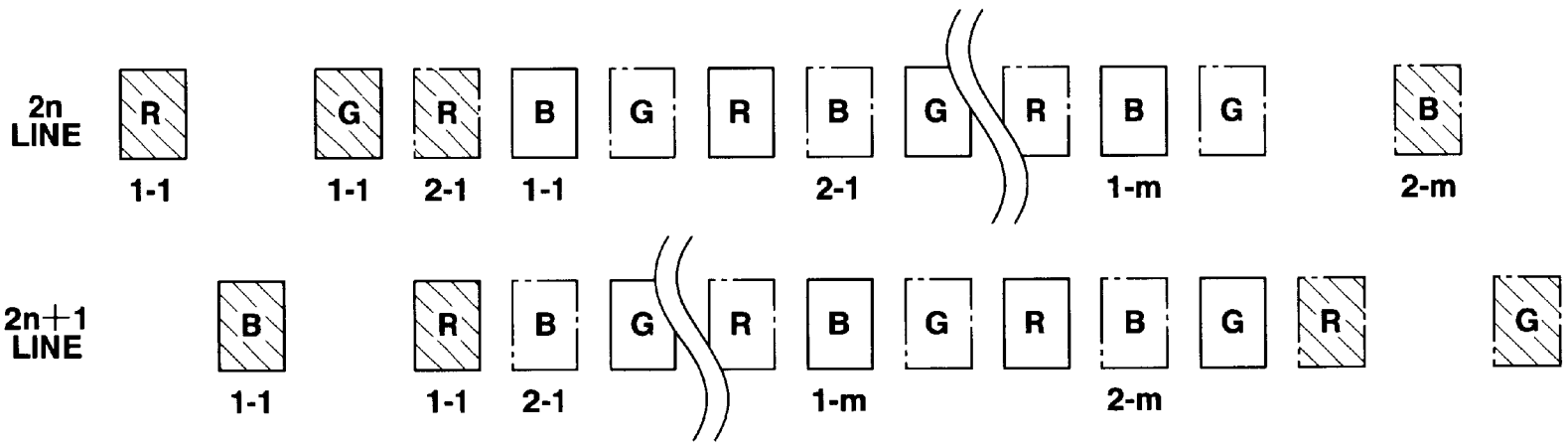
FIG. 13 is a diagram showing how pixels to be masked are different between lines in even numbers and lines in odd numbers in the above-mentioned embodiment.
Figure 14:
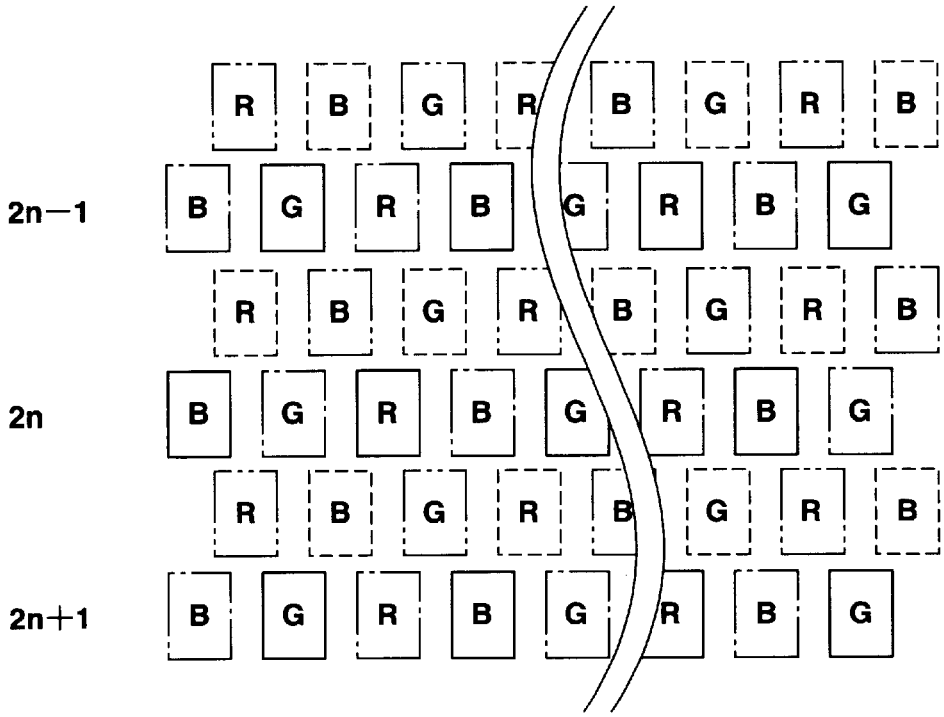
FIG. 14 is a diagram showing how areas where an image is displayed come to have uniform and dense pixel density by performing masking in the above-mentioned embodiment.

FIGS. 1 to 14 show an embodiment of the present invention. FIG. 1 is a block diagram showing electrical components related mainly to the flow of image signals in an image display device. FIG. 2 is a perspective view showing optical components of the image display device. FIG. 3 is a view showing a situation of wobbling by a liquid crystal cell and a birefringence plate in the above-mentioned embodiment, when being seen from its side. FIG. 4A is a block diagram showing components of a digital image processing unit. FIG. 4B is a block diagram showing components of a digital image processing unit of related art, which is compared with the art shown in FIG. 4A. FIG. 5 is a block diagram showing components of a mask circuit related to an R signal. FIGS. 6A to 6D are timing charts showing how an output image signal comprising two even number sub-fields and two odd number sub-fields are produced from an input image signal comprising an even number field and an odd number field. FIGS. 7A to 7F are timing charts of analogue outputs produced from digital output data on the basis of mask control signals. FIG. 8 is a view showing a pixel arrangement of a delta-arranged LCD. FIG. 9 is a view showing how apparent positions of pixels on the LCD are shifted by four-point pixel-staggering. FIG. 10 is a view showing a situation how a certain B pixel among plural pixels delta-arranged on the LCD is shifted by four-point pixel-staggering. FIG. 11 is a view showing how plural pixels delta-arranged on the LCD are shifted by four-point pixel-staggering. FIG. 12 is a view showing pixels to be masked in areas where pixel density is thin in FIG. 11. FIG. 13 is a view showing pixels to be masked are different between lines in even numbers and lines in odd numbers. FIG. 14 is a view showing a situation that areas where an image is displayed come to have uniform and dense pixel density by performing masking.

As shown in FIG. 1, this image display device has the following: an AV terminal 1 through which a composite signal VBS is inputted; a Y/C separation circuit 2 for separating the composite signal VBS inputted through the AV terminal 1 into a luminance signal Y and a color signal C; an S terminal 3 set separately from the AV terminal 1, through which an S image signal is inputted; a switch 4 for selecting and outputting, signals from the connection terminal, depending on whether the switch 4 is connected to the AV terminal 1 or the S terminal 3, a decoder 5 for converting the luminance signal Y and the color signal C from the switch 4 to signals of respective colors of red (R), green(G) and blue (B), and extracting a vertical synchronization signal VD, a horizontal synchronization signal HD and a field signal E/O; A/D converters 6*r*, 6*g* and 6*b* for sampling the R, G and B signals outputted from the decoder 5 by a sampling frequency twice the ordinary and converting the sampled signals into digital signals; a digital image processing unit 7 for subjecting the image signals digitized through the A/D converters 6*r*, 6*g* and 6*b* to various digital image processes such as contrast emphasis suitable for LCD display, and further mask-processing of the image, which will be specifically described later; D/A converters 8*r*, 8*g* and 8*b* for converting the digital R, G and B signals outputted from the digital image processing unit 7 to analogue signals; an LCD driving circuit 9 for generating LCD driving signals on the basis of outputs from the D/A converters 8*r*, 8*g* and 8*b*; an LCD 10 for displaying an image by the LCD driving signals outputted from the LCD driving circuit 9; liquid crystal cells 14 and 15 for polarizing light that is emitted from a back light 16 (see FIG. 2) described later and then emitted from the LCD 10; a liquid crystal cell driving circuit 13 for driving the liquid crystal cells 14 and 15; a timing generator 12 for the LCD (TG for the LCD) for controlling timings of the liquid crystal cell driving circuit 13 and the LCD 10; and a timing control circuit 11 for generating sample hold signals on the basis of the vertical synchronization signal VD, the horizontal synchronization signal HD and the field signal E/O outputted from the decoder 5 and then supplying timing signals to the respective circuits, such as the A/D converters 6*r*, 6*g* and 6*b*, the digital image processing unit 7, the D/A converters 8*r*, 8*g* and 8*b*, and the TG 12 for the LCD.

The following explains the optical components of the image display device, referring by FIG. 2.

This image display device has the following: a back light 16 that emits illumination light; a display element LCD 10 that is irradiated with the illumination light from the back light 16 and emits beams from an image displayed by pixels 10*a* that are regularly arranged; a liquid crystal cell 14 for polarization switching, which changes the polarization direction of the beam emitted from the LCD 10, with time being staggered, about each of its plural portions, and then emits the light resulting from the change; a birefringence plate 17 for refracting the light that has passed through the liquid crystal cell 14, depending on the polarization direction of the light; a liquid crystal cell 15 for polarization switching, which changes the polarization direction of the light that has passed through the birefringence plate 17, with time being staggered, about each of its plural portions, and then emits the light resulting from the change; a birefringence plate 18 for refracting the light that has passed through the liquid crystal cell 15, depending on the polarization direction of the light; and a birefringence plate 19 for refracting the light that has passed through the birefringence plate 18, depending on the polarization direction of the light.

The liquid crystal cell 14, the birefringence plate 17, the liquid crystal cell 15, and birefringence plates 18 and 19 constitute a wobbling optical element, which is the optical path changing means for shifting apparent positions of the pixels.

The liquid crystal cells 14 and 15 to have pairs of electrodes 14*a* and 15*a*, which are long in the horizontal direction. Each of the liquid crystal cells 14 and 15 is sandwiched in the horizontal direction between the electrodes 14*a* and 15*a*. In the embodiment shown in FIG. 2, three pairs of electrodes 14*a* and 15*a* are arranged in the vertical direction. By switching these plural pairs of the electrodes 14*a* and 15*a* on or off, the polarization direction of the light passing through the portions to which the respective pairs of the electrodes 14*a* and 15*a* are fitted is controlled.

Referring to FIG. 3, the following will describe how combinations of the liquid crystal cell and the birefringence plate are used to shift the path of light, increase the apparent number of pixels. In connection with FIG. 3, the combination of the liquid crystal cell 14 and the birefringence plate 17 will be described for simplicity.

The light emitted from the LCD 10 is light that has passed through the liquid crystal. Therefore, the light has already been polarized in one direction. For example, in the embodiment shown in FIG. 3, the light emitted from the LCD 10 is light polarized in the vertical direction.

When the light from the LCD 10 is projected onto the liquid crystal cell 14, the polarization direction of the light is changed, depending on the control states of respective portions of the electrodes 14*a*. That is, in the embodiment shown in FIG. 3, the upper electrode 14*a* causes the light to pass through the electrode 14 itself without changing the polarization state of the light. The lower electrode 14*a* causes a change in the polarization state of the light, whereby the light is polarized into the horizontal direction.

The birefringence plate 17 is made of a crystal of quartz, lithium niobate ($LiNbO_3$) or the like, in the manner that its crystal axis has an angle of 45° to the thickness direction of the plate. The light polarized in the horizontal direction is caused to pass as is. On the other hand, the light polarized in the vertical direction is caused to be refracted and is emitted. In the embodiment shown in FIG. 3, the light is emitted to be shifted slightly downwards.

For this reason, the optical path of the light which has a passed through the upper electrode 14*a* is changed so that its radiation position is shifted. Any light passes as is, i.e., without its optical path being changed, through the middle and lower electrodes 14*a*.

On the basis of this principle, a beam is shifted one direction inside the face crossing its optical axis by the combination of the liquid crystal cell 14 and the birefringence plate 17, and the beam is shifted into a different direction independent of the above-mentioned one direction, inside the face crossing its optical axis, by the combination of the liquid crystal cell 15 and the birefringence plates 18 and 19.

At this time, four-point shift can be performed, by moving apparent positions of pixels move between apexes of a parallelogram by adjusting the angle between one direction and a different direction appropriately (see FIG. 9).

Referring to FIGS. 4A and 4B, components of the digital image processing unit 7 will now be described.

FIG. 4B is a block diagram showing components of a digital image processing unit of related art, which comprises a digital image processing circuit 7*a* for performing ordinary digital image processing.

On the other hand, the digital image processing unit 7 of the present embodiment, as shown in FIG. 4A, is provided with the same digital image processing circuit 7*a* as above and, in a following stage, a mask circuit 7*b* for performing mask-processing.

This mask circuit 7*b* is made as shown in, for example, FIG. 5. FIG. 5 shows only components related to the processing of R signals inside the mask circuit 7*b*. Components related to the processing of G and B signals are the same as shown in FIG. 5.

An R signal, which is processed through the digital image processing circuit 7*a* and outputted, for example, as 8-bit digital values(DR0–DR7), is inputted into AND circuits 22.

These AND circuits 22 receive outputs from a control signal generator 21. This control signal generator 21 receives, from the timing control circuit 11, a start signal ST, a vertical synchronization signal VD, a horizontal synchronization signal HD, a clock CLK and the like, to determine whether the subject pixel is a pixel to be masked in black. When the subject pixel is a pixel to be masked, a control signal for instructing this fact is outputted.

That is, when the subject pixel is a pixel that is to be masked in black, the control signal generator 21 outputs bit "0" to all of the 8 AND circuits 22 to control all outputs from the 8 AND circuits 22 to bit "0". On the other hand, when the subject pixel is not a pixel to be masked in black, the control signal generator 21 outputs bit "1" to all of the 8 AND circuits 22 to control all outputs from the 8 AND circuits 22 as the above-mentioned R signal (DR0–DR7).

Referring to FIGS. 6A to 6D, the following will describe the attainment of double-speed for preparing, from an input image signal comprising an even number field and an odd number field, two even number sub-fields and two odd number sub-fields.

This image display device is a device for increasing the apparent number of pixels by four-point shift, as described above. The even number field and the odd number field are bisected into sub-fields.

Figures 6A, 6B, 6C, 6D:
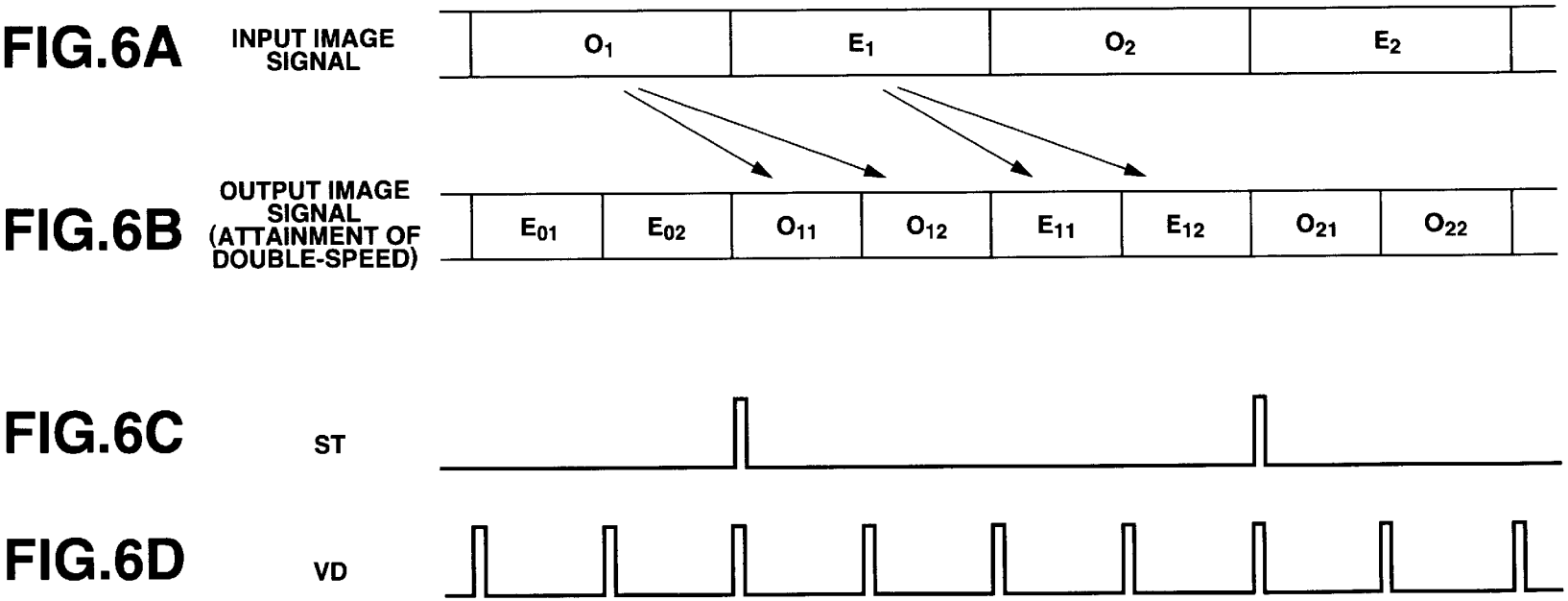
FIGS. 6A to 6D are timing charts showing how an output image signal comprising two even number sub-fields and two odd number sub-fields are produced from an input image signal comprising an even number field and an odd number field in the above-mentioned embodiment.

That is, as shown in FIGS. 6A and 6B, a first odd number field O1 is divided into two sub-fields O11 and O12, and a first even number field E1 is divided into two sub-fields E11 and E12. Subsequent odd number fields and even number fields are substantially the same as above.

Thus, one frame partitioned by start signals ST shown in FIG. 6C has therein 4 sub-fields. In the same manner, the number of pulses of a vertical synchronization signal VD shown in FIG. 6D is 4 inside one frame.

Referring to FIGS. 7A to 7F, the digital output data, the analogue outputs, a mask control signal and a D/A clock about a B signal will be described.

When the pixel arrangements are arranged in delta-arrangement, pixel positions in even,numbered rows those in odd numbered rows are shifted at a half pitch along the lateral direction, as shown in FIGS. 8 to 14 and explained specifically later.

Therefore, when wobbling is performed by means of the above mentioned wobbling optical element portions where pixels are thin are different between the even numbered rows and the odd numbered rows. That is, pixels to be masked are different between rows in even numbered rows and in odd numbered rows, as shown in FIG. 13 and explained specifically later.

How different mask controls are performed between the rows in even numbers and the rows in odd numbers shown in FIGS. 7A to 7F.

Figures 7A, 7B, 7C, 7D, 7E, 7F:
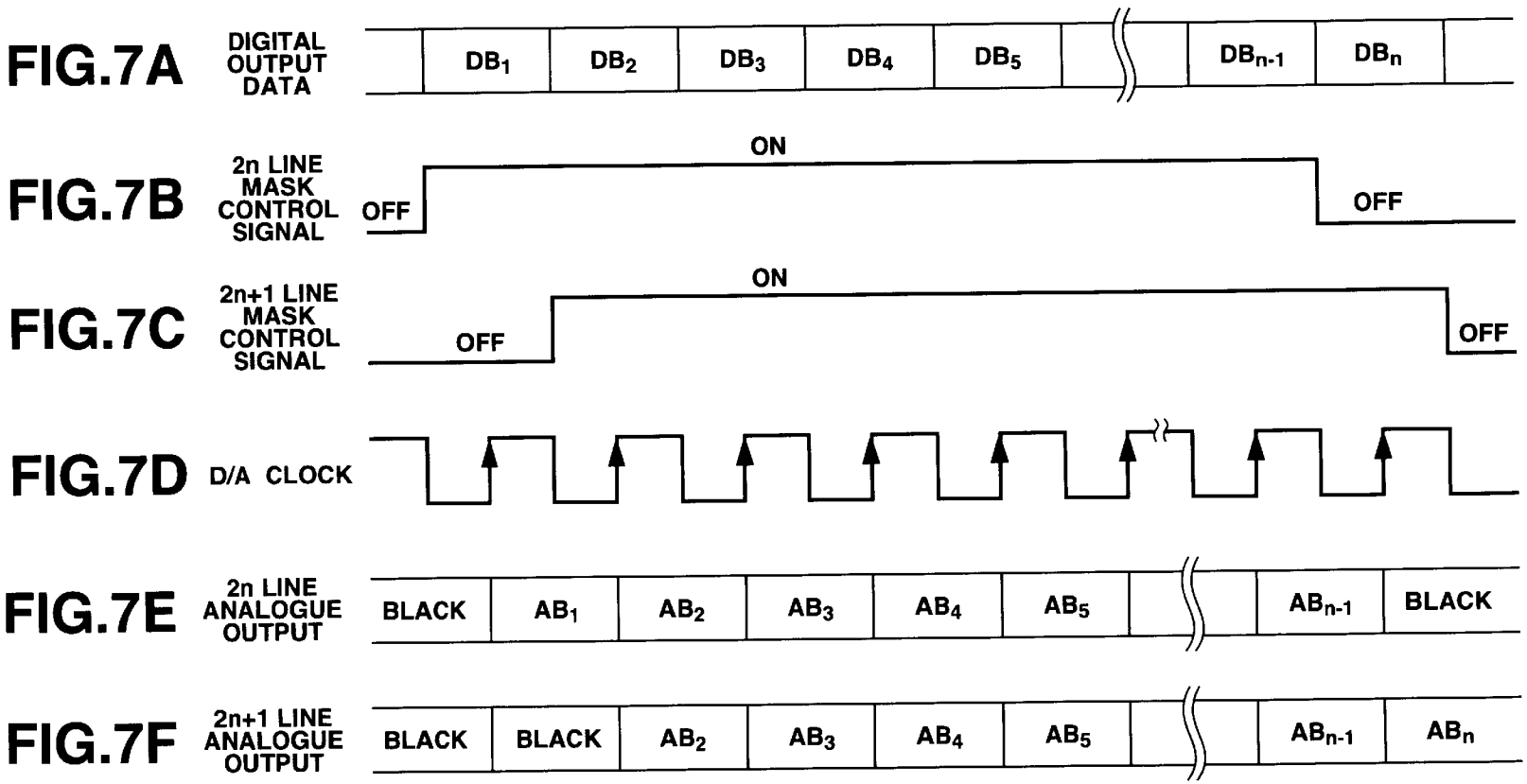
FIGS. 7A to 7F are timing charts of analogue outputs produced from digital output data on the basis of mask control signals in the above-mentioned embodiment.

That is, as shown in FIG. 7A, for example, digital output data DB1, DB2, DB3, . . . about the B signal are successively outputted from the digital image processing circuit 7*a*.

At this time, as shown in FIG. 7B, such a mask control signal is outputted from the control signal generator 21 about a 2n line to indicate that DB1 to DBn−1 are in on-states (corresponding to the above-mentioned bit "1") and data before and after DB1–DBn−1 are in off-states (corresponding to the above-mentioned bit "0").

Furthermore, a mask control signal about a 2n+1 line to indicate that DB2 to DBn are in on-states and data before and after DB2 to DBn are in off-states is outputted from the control signal generator 21, as shown in FIG. 7C.

In the D/A converter 8*b*, the digital output data DBk (k=1,2, . . . ) are converted to analogue outputs ABk, respectively, in accordance with a rising timing of the D/A clock as shown in FIG. 7D.

As a result of the above-mentioned mask control signal, about 2n line analogue outputs, AB1 to ABn−1 data are outputs related to an image, and data before and after the AB1 to ABn−1 data are outputs for display into black, as shown in FIG. 7E. On the other hand, about 2n+1 line analogue outputs, AB2 to ABn data are outputs related to the image and data before and after the AB2 to Abn data are outputs for display into black, as shown in FIG. 7F.

In this way, the mask circuit 7*b* decides pixels to be displayed in black, depending on whether the subject line is a line in an even number or a line in an odd number. That is, mask circuit 7*b* decides whether or not the subject pixel is displayed in black, depending on the number of the sub-field, the position of the line, color of the pixel and the like including the above-mentioned factors.

Referring to FIGS. 8 to 14, wobbling in the LCD 10 whose pixels are delta-arranged will be described.

In a pixel-group wherein pixels 10*a* having the pixel number of 800 in width×225 in length are delta-arranged as shown in FIG. 8, the pixels 10*a* have the following arrangement, as is well known: the pixels 10*a* of colors R, G and B are arranged in the manner that the colors are repeated in turn; even numbered row and odd numbers are arranged to be shifted by a half of the pitch of the pixels along the lateral direction; and any pixel having a certain color is arranged different color from the colors of pixels adjacent on the upper and lower sides and on the right and left sides.

The respective pixels arranged as above are shifted, for example, in the lateral direction and in an oblique direction by the combination of the liquid crystal cell 14 and the birefringence plate 17, and the combination of the liquid crystal cell 15 and the birefringence plates 18 and 19. In this manner, apparent positions of the pixels are moved between respective apexes of a parallelogram, as shown in FIG. 9.

More specifically, a pixel is positioned at a position "1" in FIG. 9, for example, by turning off the liquid crystal cells 14 and 15. The apparent position of the pixel is shifted to a position "2" in FIG. 9 by turning on the liquid crystal cells 14 and 15. The apparent position of the pixel is shifted to a position "3" in FIG. 9 by turning on the liquid crystal cell 14 and turning off the liquid crystal cell 15. The apparent position of the pixel is shifted to a position "4" by turning off the liquid crystal cell 14 and turning on the liquid crystal cell 15. Subsequently, the pixel is returned to the position "1" in FIG. 9 by turning off the liquid crystal cells 14 and 15. The detail of this action is described in Japanese Patent Application No. Hei 10-336482.

When the action is started, for example, from an odd field, in connection with output image signals shown in FIGS. 6A to 6D, the positions "1", "2", "3" and "4" correspond to the odd field O11, the odd field O12, the even field E11 and the even field E12, respectively. Thereafter, these positions correspond in the same manner.

FIG. 10 shows shifting of, for example, a B pixel by such action as above.

The leftmost B pixel in the 2n+1 line, among pixels arranged in the LCD 10, which is shown by a solid line, is a state where any apparent gap of the pixel is substantially removed by turning off the liquid crystal cells 14 and 15. This state corresponds to the position "1".

By turning on the liquid crystal cells 14 and 15, the apparent position of the pixel is shifted to a position which is shown by an alternate long and short dash line and is present between the adjacent R and G pixels in the 2n+1 line. This state corresponds to the position "2".

Next, by keeping the liquid crystal cell 14 turned on and turning off the liquid crystal cell 15, the apparent position of the pixel is shifted to a position which is shown by a dotted line and is present between a G pixel right adjacent to the B pixel shown by the above-mentioned alternate long and short dash line and an R pixel, in the upper 2n line, upper right adjacent to the G pixel described just above. This state correspond to the position "3".

Furthermore, by turning off the liquid crystal cell 14 and turning on the liquid crystal cell 15, the apparent position of the pixel is shifted to a position which is shown by an alternate long and two short dashed lines and is present between an R pixel left adjacent to the B pixel shown by the above-mentioned alternate long and short dashed line and a G pixel, in the upper 2n line, upper left adjacent to the R pixel described just above. This state corresponds to the position "4".

Subsequently, by keeping the liquid crystal cell 14 turned off and turning off the liquid crystal cell 15, the B pixel is returned to the leftmost position which is, in the 2n+1 line, shown by the solid line and corresponding to the position "1".

Of course, all pixels are shifted by means of the liquid crystal cells 14 and 15. Therefore, the shifted pixels are as shown in FIG. 11.

As is understood from FIG. 11, if apparent positions of the pixels are shifted by wobbling of the pixels as described above, areas where pixel density is thin are generated at right and left end areas.

If an image is displayed at areas including such areas as above, the areas cause roughness or flicker of the image. Thus, the right and left end areas, where pixel density is thin, are displayed in black and masked as described above. The pixels to be masked are, for example, areas shown by oblique lines.

At this time, pixels to be masked in actual pixel rows in the LCD 10 are appropriately controlled on the basis of sub-field numbers, the line position as to whether the subject line is a line in an even number or a line in an odd number, and the pixel color as to whether the color of the subject pixel is R. G or B.

The mask circuit 7*b* is composed to determine whether the subject pixel is made black or not on the basis of two or three of all the above-mentioned data. Specifically, as shown in FIG. 5, the control signal generator 21 examines these three conditions on the basis of the start signal ST, the vertical synchronization signal VD, the horizontal synchronization signal HD and the clock CLK, to output control signals.

A result thereof is as shown in, for example, FIG. 13. That is, in a certain sub-field the leftmost pixel B in the 2n+1 line is masked but in another sub-field the same B pixel on the LCD 10 is not masked as shown by an alternate long and short dash line (B2−1).

Furthermore, in the same sub-field, the leftmost R pixel and the adjacent G pixel are masked in the 2n line while the leftmost B pixel and the adjacent R pixel are masked in the 2n+1 line. Such control is performed.

In the above-mentioned manner, the pixels at the right and left end areas are mask-controlled as shown by the oblique lines in FIG. 12 on the basis of the sub-field number, the line position, the pixel color and the like. As a result thereof, uniform and dense pixel distribution can be obtained, as shown in FIG. 14, so that the whole of the resultant image can be with high quality.

The above description is about a case in which the pixels of the LCD are delta-arranged, but the present invention is not limited to this case. The present invention can be applied to other arrangements, for example, stripe-arrangement.

The above description is about a case in which the right and left end areas in a screen are displayed in black, but the present invention is not limited to this case. Areas where pixel density is thin at upper and lower end may be masked in black.

The above description is about a case in which masking in black is attained, but the present invention is not limited to this case. It is sufficient that display of images is prohibited in areas where pixel density is thin.

The above description is about a case of wobbling by four-point shift, but the present invention can be applied to two-point shift or multipoint shift. An image to be displayed is not limited to a color image.

The above description is about a case in which the mask circuit 7*b* is disposed inside the digital image processing unit 7, but the present invention is not limited to this case. There may be disposed a circuit for performing mask-processing after converting signals to analogue signals through the D/A converters 8r, 8g and 8b. In this case, the signal level of pixels to be displayed in black is controlled to fall in, for example, a ground level.

According to an embodiment as described above, in an image display device for increasing the apparent number of pixels by dividing one frame into, for example, four sub-fields and performing pixel-staggering successively, display of any image is not prohibited in areas where the apparent density of the pixels is thin, and display in black is attained in these areas. Therefore, it is possible to obtain uniform and dense pixel distribution, make the whole of the resultant image high quality, and display the whole of the image so that it can be easily watched.

In this invention, it is apparent that working modes different in a wide range can be formed on the basis of this invention without departing from the spirit and scope of the invention. This invention is not restricted by any specific embodiment except being limited by the appended claims.

What is claimed is:

1. An image display device comprising:

a display element including a plurality of two-dimensionally arranged pixels;

image processing means for controlling in the display element for each pixel to display an image on the basis of image signals;

optical path changing means for sequentially refracting optical paths of beams emitted from the display element to perform pixel-staggering; and mask means for displaying at least one of end areas in the horizontal direction and end areas in the vertical direction in black when pixel-staggering is performed by the optical path changing means;

wherein the optical path changing means is for performing the pixel-staggering by shifting apparent positions of the pixels, by a length longer than the pitch between the pixels, in at least one direction of the horizontal direction and the vertical direction; and the mask means is for displaying, in black, both end areas in the direction along which the apparent positions of the pixels are shifted by the length longer than the pitch between the pixels.

2. The image display device according to claim 1, wherein the mask means is means for detecting position of the pixel and then, when the detected pixel position is a position to be masked, displaying the pixel in black.

3. The image display device according to claim 2, wherein the optical path changing means makes it possible to perform pixel-staggering for refracting the optical paths of the beams into independent directions inside the face crossing the optical paths, independently for each of the directions, and which sequentially performs the pixel-staggering, for each of sub-fields resulting from division of a field, by combining these independent refractions of the optical paths successively; and the mask judges whether the pixel is displayed in black or not on the basis of at least two of the number of its sub-field, its line position and its color.

4. An image display device comprising:

a display element including a plurality of two-dimensionally arranged pixels;

an image processor that controls the display element for each pixel to display an image on the basis of image signals;

an optical path changer that sequentially refracts optical paths of beams emitted from the display element to perform pixel-staggering; and a mask facility that displays at least one of end areas in the horizontal direction and end areas in the vertical direction in black when pixel-staggering is performed by the optical path changer;

wherein the optical path changer serves to perform the pixel-staggering by shifting apparent positions of the pixels, by a length longer than the pitch between the pixels, in at least one direction of the horizontal direction and the vertical direction; and the mask facility serves to display, in black, both end areas in the direction along which the apparent positions of the pixels are shifted by the length longer than the pitch between the pixels.

* * * * *